US005555583A

United States Patent [19]

Berkcan

[11] Patent Number: 5,555,583

[45] Date of Patent: Sep. 17, 1996

[54] DYNAMIC TEMPERATURE COMPENSATION METHOD FOR A TURBIDITY SENSOR USED IN AN APPLIANCE FOR WASHING ARTICLES

[75] Inventor: Ertugrul Berkcan, Schnectady, N.Y.

[73] Assignee: General Electric Company, Schenectady, N.Y.

[21] Appl. No.: 386,382

[22] Filed: Feb. 10, 1995

[51] Int. Cl.[6] ..... D06F 33/02

[52] U.S. Cl. ..... 8/158; 68/12.02; 134/113; 134/57 D; 134/58 D

[58] Field of Search ..... 134/57 D, 58 D, 134/113; 68/12.02; 8/159, 158; 340/619; 250/564, 565; 356/436, 441, 442

[56] References Cited

U.S. PATENT DOCUMENTS

| | | | |
|---|---|---|---|
| 3,539,153 | 11/1970 | Wennerberg et al. | 134/57 D |
| 3,870,417 | 3/1975 | Bashark | 134/57 D |
| 4,037,966 | 7/1977 | Hill . | |
| 5,048,139 | 9/1991 | Matsumi et al. . | |
| 5,083,447 | 1/1992 | Kiuchi et al. . | |
| 5,105,635 | 4/1992 | Kiuchi et al. . | |
| 5,136,861 | 8/1992 | Kiuchi et al. . | |
| 5,140,168 | 8/1992 | King . | |
| 5,172,572 | 12/1992 | Ono . | |
| 5,265,446 | 11/1993 | Kuroda et al. . | |
| 5,291,626 | 3/1994 | Molnar et al. . | |
| 5,297,307 | 3/1994 | Baek . | |
| 5,331,177 | 7/1994 | Kubisiak et al. . | |
| 5,419,163 | 5/1995 | Kim et al. | 68/12.02 |
| 5,438,507 | 8/1995 | Kim et al. | 68/12.02 |

FOREIGN PATENT DOCUMENTS

| | | | |
|---|---|---|---|
| 2-539611 | 7/1984 | France | 134/58 D |
| 61-16788 | 1/1986 | Japan | 68/12.02 |
| 64-37996 | 2/1986 | Japan | 68/12.02 |
| 61-59760 | 12/1986 | Japan | 68/12.02 |
| 4-279136 | 10/1992 | Japan | 134/57 D |
| 6-105787 | 4/1994 | Japan | 134/58 D |
| 1559020 | 4/1990 | U.S.S.R. | 68/12.02 |

OTHER PUBLICATIONS

"A New Control Device for Washing Machines Using a Microcomputer and Detectors" by K. Matsuo and K. Taniguchi, IEEE Transactions on Industry Applications, vol. IA-20, No. 5, Sep./Oct. 1984, pp. 1171–1178.

*Primary Examiner*—Frankie L. Stinson
*Attorney, Agent, or Firm*—Marvin Snyder

[57] ABSTRACT

A dynamic temperature compensation method for a turbidity sensor in an appliance for washing articles is provided. The method includes the steps of: retaining substantially particle-free liquid upon completion of cleansing operations in the appliance, reading initial values of temperature and turbidity of the liquid, measuring additional values of temperature and turbidity of the liquid at predetermined time intervals, and calculating a temperature coefficient, based upon respective ones of the initial and the additional values of temperature and turbidity, for characterizing a temperature response of the turbidity sensor over a predetermined temperature range.

7 Claims, 5 Drawing Sheets

DYNAMIC TEMPERATURE COMPENSATION METHOD FOR A TURBIDITY SENSOR USED IN AN APPLIANCE FOR WASHING ARTICLES

RELATED APPLICATIONS

This application is related to U.S. patent application Ser. No. (386,383) (RD-24,017) by E. Berkcan, entitled "A Temperature Compensation Method for a Turbidity Sensor Used In An Appliance For Washing Articles", filed concurrently herewith, assigned to the assignee of the present invention and herein incorporated by reference.

BACKGROUND OF THE INVENTION

The present invention relates to temperature compensation and, more particularly, to a dynamic temperature compensation method for a turbidity sensor used in an appliance for washing articles.

Reducing the amount of energy consumption in appliances or machines for washing articles, such as dishwashers or clothes washers, is a significant problem, in part because a large amount of energy is needed to heat the liquid, such as water, for washing such articles. Thus, decreased liquid consumption for such machines may result in significant improvements in energy efficiency. Several techniques are available to indirectly monitor cleanliness of the articles, including a device for measuring or sensing the turbidity of the liquid used to wash the articles.

Turbidity sensors that employ an electromagnetic radiation source, such as a light emitting diode (LED) for emitting electromagnetic radiation which propagates within the cleansing liquid, typically suffer from temperature variation effects, such as power output variation as a function of temperature. The temperature variations effects, if left uncorrected, can substantially degrade the accuracy of the turbidity sensor. For example, an LED having a temperature coefficient of about 4,000 parts per million (ppm) per °C can result in unacceptable accuracy over the temperature range of operation of the turbidity sensor. U.S. patent application Ser. No. [388,383] (RD-24,017) entitled "Temperature Compensation Method For A Turbidity Sensor Used In An Appliance For Washing Articles", by E. Berkcan, assigned to the same assignee of the present invention, filed concurrently herewith and herein incorporated by reference, provides a temperature compensation method which advantageously allows for adjusting any turbidity measurements or values obtained during cleansing operations. The adjustment is based on factory-determined temperature compensation parameters, such as the temperature coefficient of the LED. These factory-determined parameters allow for determining the response of the LED, and, in turn, the response of the turbidity sensor as a function of temperature, at least over a desired temperature range. Although the above-referred application allows for substantially reducing turbidity sensor errors due to temperature variation effects in the LED, it will be appreciated that the factory-determined compensation parameters are generally derived from the temperature response of randomly selected LED samples which may somewhat deviate from the actual response of any specific LED. Typically, such factory-derived parameters are then stored in a memory module while the appliance is being assembled in the factory. Once the appliance is deployed in the field such factory-derived parameters remain fixed in the memory module and thus the temperature compensation capability may be somewhat reduced if the temperature response of the sensor changes in the field due to aging and other conditions, such as environmental conditions and/or field replacement of the sensor with a modified LED model. Thus, it is desirable to provide a temperature compensation method based on compensation parameters which can be dynamically derived even after the appliance is deployed in the field, i.e., outside the factory. It is further desirable to provide a dynamic temperature compensation method based on the specific temperature response of the actual LED used in any given appliance.

SUMMARY OF THE INVENTION

Generally speaking, the present invention fulfills the foregoing needs by providing a dynamic temperature compensation method for a turbidity sensor in an appliance for washing articles. The method comprises the steps of: retaining substantially particle-free liquid upon completion of cleansing operations in the appliance, reading initial values of temperature and turbidity of the liquid, measuring additional values of temperature and turbidity of the liquid at predetermined time intervals, and calculating a temperature coefficient, based upon respective ones of the initial and the additional values of temperature and turbidity, for characterizing a temperature response of the turbidity sensor over a predetermined temperature range.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like numbers represent like parts throughout the drawings, and in which:

DETAILED DESCRIPTION OF THE INVENTION

Figure 1:
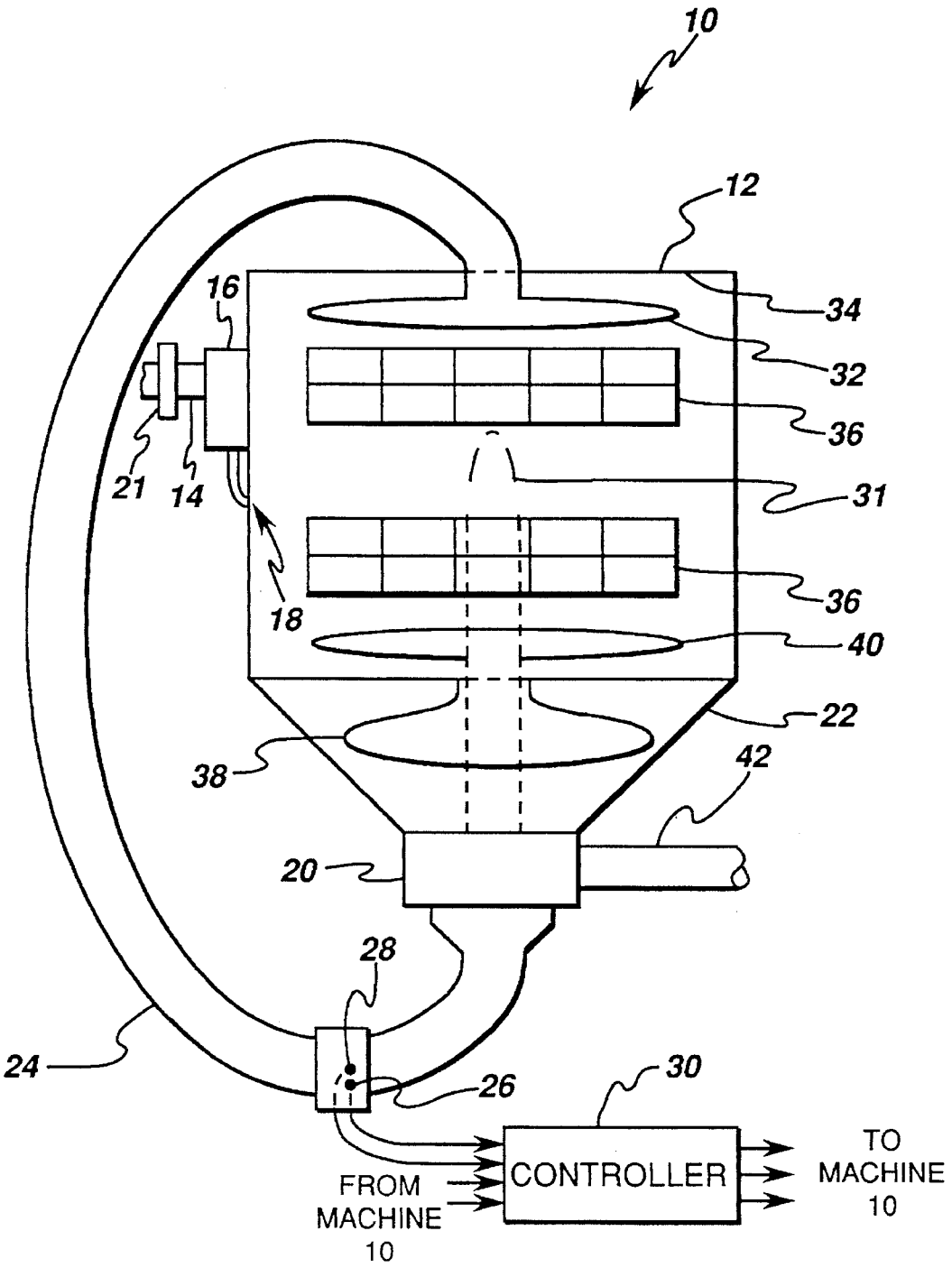
FIG. 1 is a schematic diagram of a dishwasher using a method embodying the present invention.

FIG. 1 is a schematic of an appliance 10 for cleansing articles and using a method in accordance with the present invention. Although the appliance is described as a dishwasher, it will be appreciated that a clothes washer can also benefit from the teachings of the present invention. The appliance 10 includes a container 12 for containing articles during a washing. Clean water is sent to the container via a valve 21, a conduit 14, a fill funnel 16, and an aperture 18. The water is distributed and recirculated by a pump 20. In particular, water from a sump 22 is distributed from pump 20 via a recirculation hose 24. A turbidity sensor 26 and a temperature sensor 28 mounted within recirculation hose 24 measure the turbidity in the recirculation hose and the temperature of the water in the recirculation hose, respectively. Although turbidity sensor 26 is shown in FIG. 1 as being attached to recirculation hose 24, this sensor should not be limited to this location and can also be located at other locations such as the container or the pump.

Figure 2:
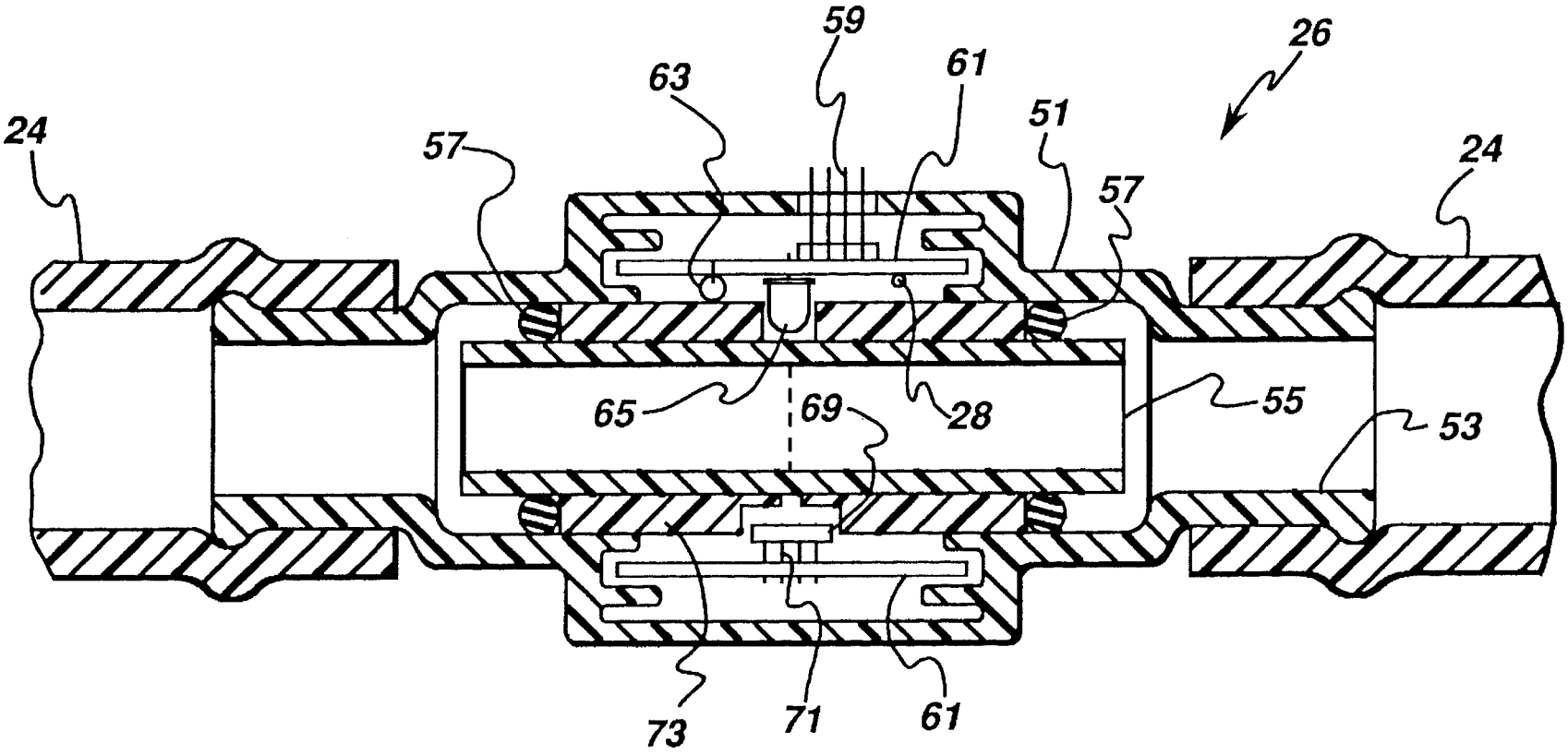
FIG. 2 is a cross-sectional view of a turbidity sensor used in the dishwasher of FIG. 1.

A more detailed view of turbidity sensor 26 and temperature sensor 28 is shown in the cross-sectional view of FIG. 2. The turbidity sensor includes a housing 51. At one end of housing 51 is a fluid flow channel 53 which is coupled to recirculation hose 24 and permits liquid to flow therethrough. Liquid flows through fluid flow channel 53 into a quartz tube 55 located inside housing 51 and coupled thereto by 0-rings 57. Located above the top of quartz tube 55 is a printed circuit board 61 having a light emitting diode (LED) 65, a resistor 63, temperature sensor 28 which happens to be a thermistor, and a plurality of connectors 59 extending therefrom. It will be appreciated that other schemes can be conveniently employed for obtaining temperature measurements. For example, in an alternative embodiment, temperature sensor 28 can be conveniently deleted being that LED 65 can be effectively employed both as the source of electromagnetic radiation and as the temperature sensor being that the temperature response of an LED can be accurately characterized by a linear equation over the temperature range of interest. At the bottom of quartz tube 55 is another printed circuit board 61 having various electrical components. In particular, bottom printed circuit board 61 comprises a light-to-frequency converter 69, and a plurality of connectors 71. The electronics on printed circuit board 61 are positioned within housing 51 relative to quartz tube 55 by a cylindrical spacer 73. As the liquid flows through fluid flow channel 53 into quartz tube 55, electromagnetic radiation emitted by LED 65 passes through the liquid along an optical axis, which is represented by the dotted line in FIG. 2. The intensity of the light passing through the liquid decays exponentially relative to the amount of soil therein. If there is a high soil level, then there will be a relatively small amount of radiation passing through the liquid, while a lower soil level will allow relatively more radiation passing through. The intensity of radiation received at light-to-frequency converter 69 is converted into a frequency representation by light-to-frequency converter 69 and sent to a controller 30. A more detailed explanation of the turbidity sensor is provide in commonly assigned, US patent application Ser. No. (330,795) [(Attorney Docket No. 9D-DW-18700], entitled "Dishwasher With Turbidity Sensing Mechanism", which is incorporated herein by reference. In addition to receiving the turbidity measurements from turbidity sensor 26, controller 30 receives the temperature measurements from temperature sensor 28. Additional details about the operation of controller 30 are provided in commonly assigned, U.S. patent application Ser. No. (370,792) [Attorney Docket No. RD-23,989], entitled "A System And Method For Adjusting The Operating Cycle Of A Cleaning Appliance", which is incorporated herein by reference.

Figure 3:
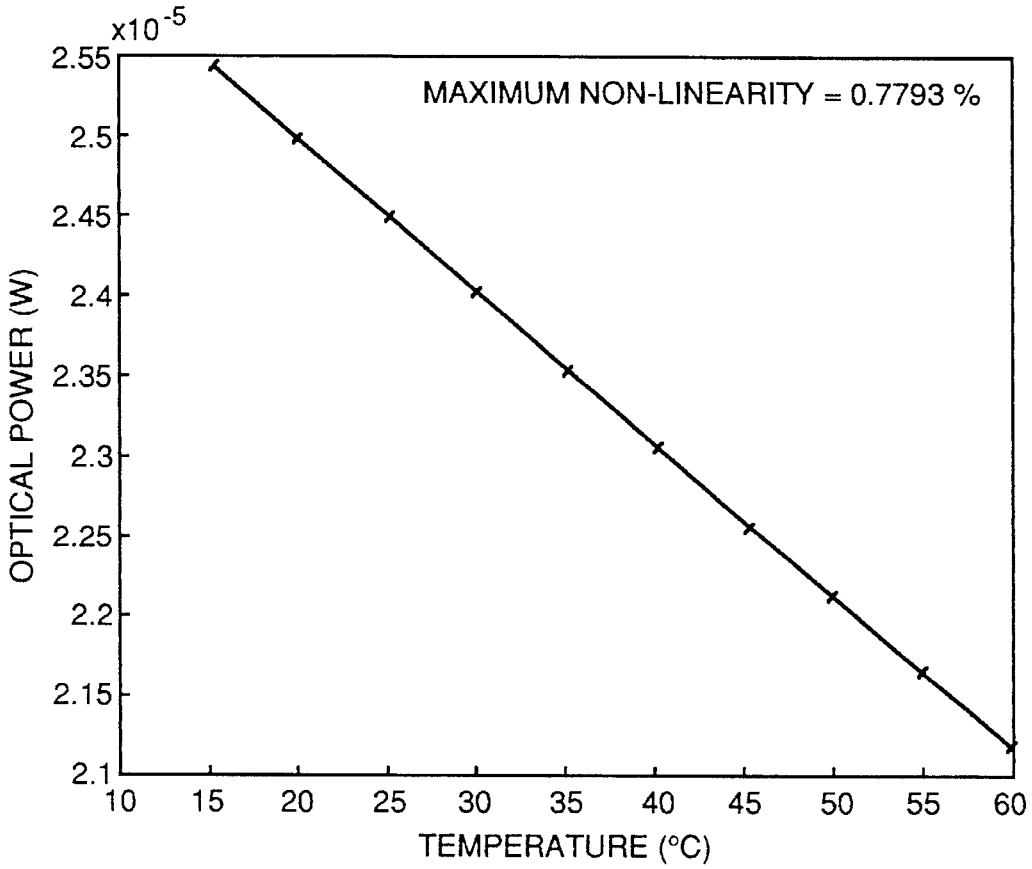
FIG. 3 is a graph showing the effects that temperature has on the optical power output of a light emitting diode located within the turbidity sensor.

FIG. 3 is a graph showing the relationship between the optical power output of LED 65 and the temperature of the liquid. The graph shows that as the temperature increases, the optical power or brightness of LED 65 decreases. Conversely, as the temperature decreases, the optical power or brightness of LED 65 increases.

Figure 4:
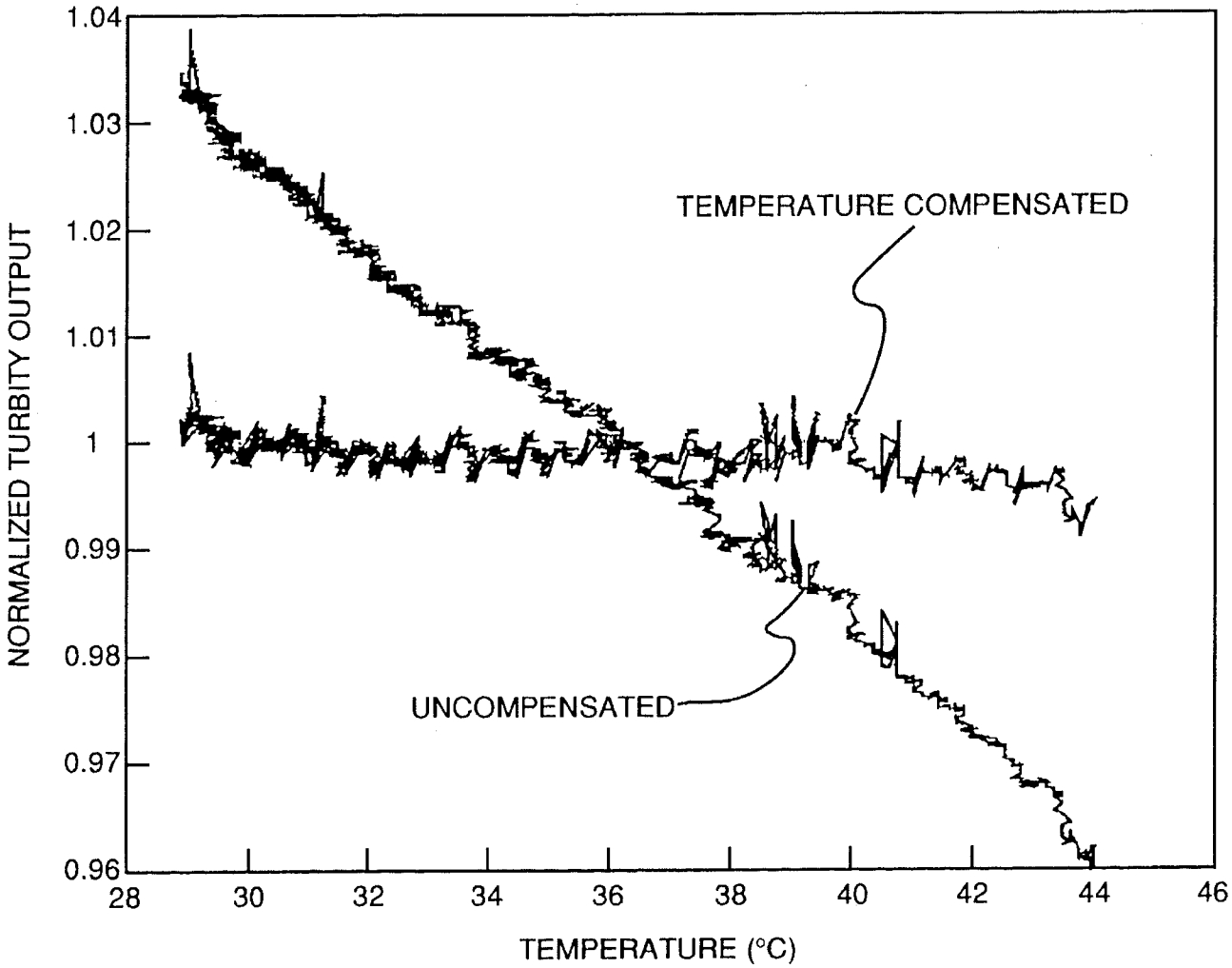
FIG. 4 is a performance curve showing the effects that temperature has on the measured turbidity values.

FIG. 4 is a performance curve that illustrates the effect that temperature has on the values for turbidity measurements from turbidity sensor 26. In particular, FIG. 4 shows that as temperature increases, the values for turbidity measurements actually decrease. As suggested above, the values for turbidity measurements actually decrease in the performance curve because the optical power or brightness of the LED 65 is decreasing as the temperature increases (see FIG. 3). If the optical brightness is decreasing, then the measured turbidity values will decrease, and not accurately reflect the true or actual turbidity of the liquid. Thus, the turbidity measured by turbidity sensor 26 should be compensated to account for the changes occurring due to temperature variations.

Figure 5:
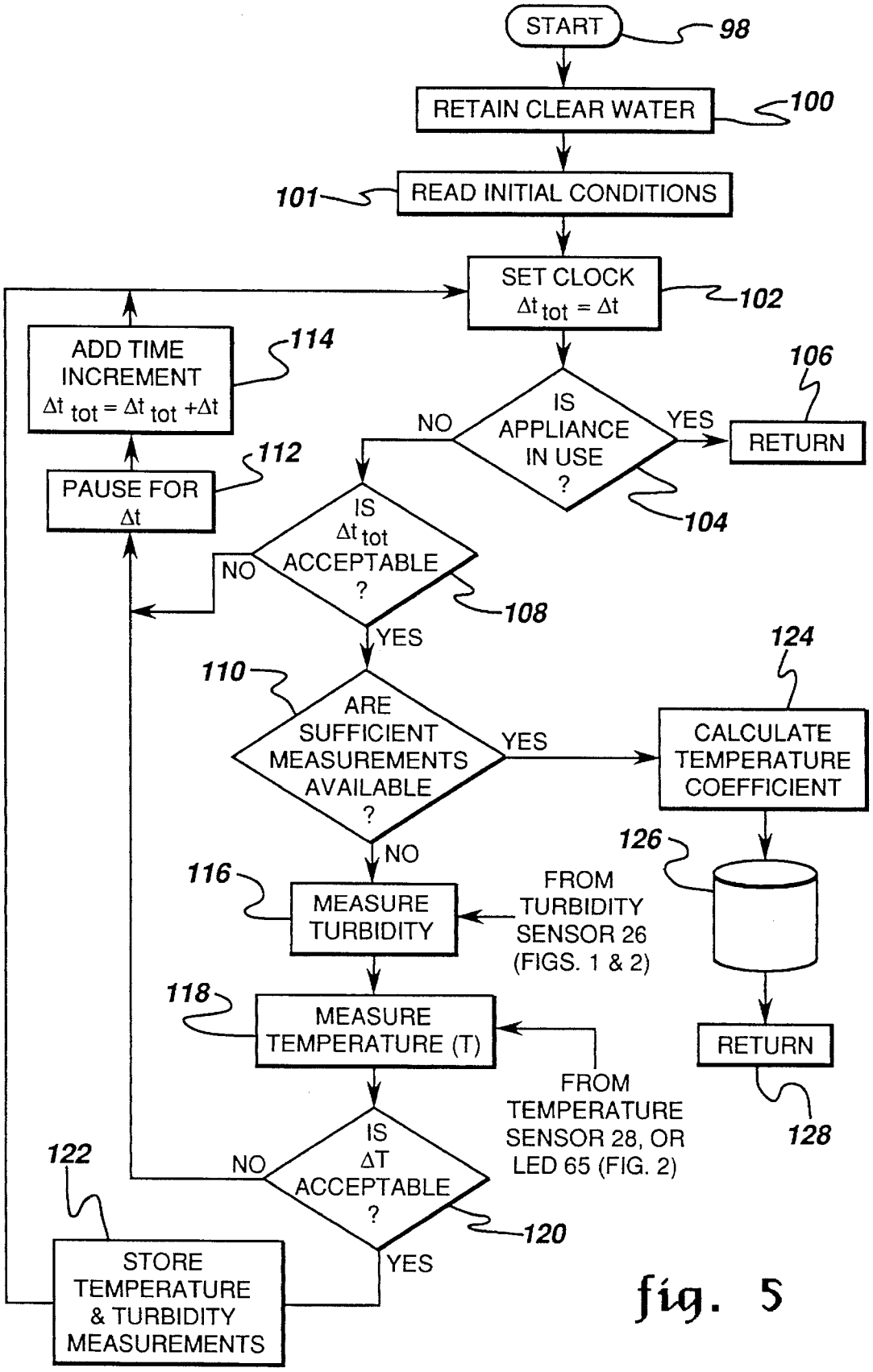
FIG. 5 is a flowchart illustrating a sequence of steps for a dynamic temperature compensation method in accordance with the present invention.

FIG. 5 is a flowchart that illustrates a sequence of steps in accordance with the present invention. After start of operations in step 98, step 100 allows for retaining substantially particle-free liquid, such as clean water, upon completion of cleansing operations in appliance 10 (FIG. 1 ). For example, the clean water can be readily retained within the turbidity sensor after completion of the final rinse cycle of a wash. Step 101 allows for reading initial values of temperature and turbidity of the retained liquid following the wash. These initial values can be conveniently read from a memory in controller 30 and allow for establishing the initial conditions for the temperature and turbidity. By way of example, the initial values for temperature and turbidity may correspond to measurements obtained prior to completion of the final rinse cycle of the wash.

Since the temperature of the water upon completion of cleansing operations is, in general, at a higher temperature than the temperature of the surrounding environment where the appliance is operated, it will become apparent that the temperature response of the turbidity sensor can be conveniently characterized by measuring at predetermined time intervals additional values of temperature and turbidity of the retained water, as the turbidity sensor and the water gradually cool down. Step 102 allows for setting a clock that enables measuring and keeping track of the predetermined time intervals. Step 104 allows for verifying that appliance 10 has not resumed cleansing operations being that if the appliance has resumed operations, then as shown in step 106, the dynamic temperature compensation is discontinued. Step 108 allows for determining whether any time interval measured in step 102 is acceptable, i.e., whether the range of the time interval is sufficient for allowing at least some moderate cooling of the turbidity sensor and the water therein. The acceptability of any predetermined time interval can vary depending on factors such as the cooling rate characteristics of a given turbidity sensor or the temperature of the surrounding environment where the appliance operated. If the measured time interval is not acceptable, step 112 allows for pausing for an additional time interval. Step 114 allows for summing each time interval so as to obtain an indication of the total time intervals elapsed from the completion of cleansing operations in the washing machine as well as time elapsed between measurements of additional values of temperature and turbidity, as described below. Step 110 allows counting the number of stored values of temperature and turbidity. It will be recognized that in a first pass or iteration, step 110 simply leads, respectively, to measuring steps 116 and 118 being that no measurements of temperature and turbidity have occurred yet and therefore the number of stored values of temperature and turbidity is zero at this point, except for the respective temperature and turbidity initial values obtained in step 101. As previously suggested, measuring steps 116 and 118, respectively, allow for measuring additional values of turbidity and temperature at predetermined time intervals. Step 122 allows for storing each last-measured pair value of temperature and turbidity whenever a temperature change sensed in step 120 between the last-measured temperature value and the temperature value measured preceding the last-measured temperature value exceeds a predetermined threshold temperature. Step 120 avoids storing an excessive number of temperature and turbidity values being that if the temperature change between the last-measured temperature value and the preceding temperature value does not exceed the threshold temperature, then step 112 allows for pausing, as suggested above, for an additional time interval that allows further cooling of the turbidity sensor and the water in the turbidity sensor. It will be appreciated that if temperature and turbidity values were stored regardless of the actual temperature change with respect to a preceding temperature value, this would lead to an excessive and unnecessary number of turbidity and temperature values over the temperature range of interest.

It will become apparent that upon the execution of additional iterations, the number of stored temperature and turbidity values will increase until the count number from step 110 reaches a predetermined value. For example, upon determining that a sufficient number of stored values for temperature and turbidity are available, calculating step 124 can then be conveniently executed. Calculating step 124 allows for calculating a temperature coefficient, based upon the initial and the additional values of temperature and turbidity, such as the stored values of temperature and turbidity. The temperature coefficient advantageously allows for accurately characterizing the temperature response of the turbidity sensor over the predetermined temperature range. The temperature coefficient can then be stored in a memory 126, such as a read only memory (ROM) or an electrically erasable programmable read only memory (EEPROM) in controller 30 (FIG. 1 ). For example, and as described below, the temperature coefficient can be conveniently employed for adjusting turbidity values supplied by the turbidity sensor once the appliance resumes cleansing operations. In particular, the supplied turbidity can be adjusted based on the stored temperature coefficient to provide temperature compensated turbidity values.

It will be appreciated that temperature compensation can be achieved by determining offset or adjustment values that are to be added to or subtracted from the turbidity measurements from turbidity sensor 26 (FIGS. 1 and 2), depending on the temperature measured by temperature sensor 28 (FIGS. 1 and 2), or, as previously suggested, by LED 65. In each case, the offset or adjustment values are attained by choosing a temperature reference value to be within the operating temperature range of appliance 10. In the illustrative embodiment, the operating range of appliance 10 is between 24° C. and 74° C. and the temperature reference value is conveniently chosen to be 49° C. Since 49° C. is the temperature reference value, it would be preferred if the turbidity measurements were compensated to reflect the turbidity values calculated at the reference temperature. It will be appreciated that the present invention need not be limited to such specific reference temperature value being that other values for temperature reference can work equally effective. The adjustment of the turbidity measurements to the temperature reference value (i.e., 49° C.) is attained by using a linear equation whose slope comprises the stored temperature coefficient. By using linear equations, offset or adjustment values for each possible temperature value in the operating temperature range can be calculated and used to compensate the turbidity measurements. In the illustrative embodiment, if the measured temperature is greater than 49° C., then turbidity measurements are below the compensated level, and thus, the corresponding turbidity measurements need to be increased by an offset value to increase their respective level (see FIG. 4). If the measured temperature values are less than 49° C., then the turbidity measurements are above the compensated level, and thus, the corresponding turbidity measurements need to be decreased by an offset value to decrease their respective level (see FIG. 4). However, if the measured temperature is equal to 49° C., then the corresponding turbidity measurements do not need to be offset or adjusted. In the illustrative embodiment, the offset values are stored in a look-up table stored in a memory (not shown), such as a read only memory (ROM) or an electrically erasable programmable read only memory (EEPROM) in controller 30 (FIG. 1 ). Thus, as controller 30 receives a turbidity measurement from turbidity sensor 26 and a temperature measurement from temperature sensor 28, the controller will refer the measured temperature to the look-up table of offset values. The controller will then read the offset value corresponding to the measured temperature and adjust the turbidity measurement accordingly. As described in copending application, Ser. No. [386,383] (RD-24,017), normalized turbidity values are desirable being that such normalized turbidity values allow for performing sell-calibration of the turbidity sensor and for controlling the intensity of the electromagnetic radiation source. For example, the self-calibration of the turbidity sensor can be performed by measuring the electromagnetic radiation transmitted or scattered when substantially particle-free liquid, such as substantially clear or clean water, is disposed between LED 65 (FIG. 2) and light-to frequency converter 69 (FIG. 2). As will be appreciated by those skilled in the art, any signals or measurements produced by the turbidity sensor during any given cycle of operation of the appliance can then be conveniently normalized or compared with the appropriate transmission and scatter values of electromagnetic radiation propagated through the substantially particle-free liquid.

While only certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

What is claimed is:

1. A dynamic temperature compensation method for a turbidity sensor used in an appliance for cleansing articles, said method comprising:

retaining substantially particle-free liquid upon completion of cleansing operations in said appliance;

reading initial values of temperature and turbidity of said liquid;

measuring additional values of temperature and turbidity of said liquid at predetermined time intervals; and calculating a temperature coefficient, based upon respective ones of said initial and additional values of temperature and turbidity, for characterizing a temperature response of said turbidity sensor over a predetermined temperature range.

2. The dynamic temperature compensation method of claim 1 and further comprising the step of verifying that said appliance has not resumed cleansing operations while measuring each additional value of temperature and turbidity.

3. The dynamic temperature compensation method of claim 2 wherein the step of measuring the additional values of temperature and turbidity comprises the step of storing each last-measured value of temperature and turbidity whenever a temperature change sensed between the last-measured temperature value and the temperature value measured preceding the last-measured temperature value exceeds a predetermined threshold temperature.

4. The dynamic temperature compensation method of claim 3 wherein the step of measuring the additional values of temperature and turbidity further comprises the step of pausing for an additional time interval whenever the temperature change sensed between the last-measured temperature value and the temperature value measured preceding the last-measured temperature value is below the predetermined threshold temperature.

5. The dynamic temperature compensation method of claim 4 further comprising the step of counting the number of stored values of temperature and turbidity.

6. The dynamic temperature compensation method of claim 5 wherein the step of calculating said temperature coefficient is executed when the count number for the stored values of temperature and turbidity reaches a predetermined value.

7. The dynamic temperature compensation method of claim 6 further comprising the step of storing the calculated temperature coefficient so that turbidity values measured upon said appliance resuming cleansing operations can be adjusted based on the stored temperature coefficient to provide temperature compensated turbidity values.

* * * * *